US005823243A

United States Patent [19]

Kelly

[11] Patent Number: 5,823,243

[45] Date of Patent: Oct. 20, 1998

[54] LOW-POROSITY GAMMA TITANIUM ALUMINIDE CAST ARTICLES AND THEIR PREPARATION

[75] Inventor: Thomas J. Kelly, Cincinnati, Ohio

[73] Assignee: General Electric Company, Cincinnati, Ohio

[21] Appl. No.: 775,700

[22] Filed: Dec. 31, 1996

[51] Int. Cl.[6] ..... B22D 27/20

[52] U.S. Cl. ..... 164/57.1; 164/516

[58] Field of Search ..... 164/516, 517, 164/55.1, 57.1, 72

[56] References Cited

U.S. PATENT DOCUMENTS 3,158,912 12/1964 Schweikert .
3,614,976 10/1971 Bolling et al. ..... 164/122
5,314,000 5/1994 Wang et al. ..... 164/4.1
5,337,800 8/1994 Cook ..... 164/72
5,354,351 10/1994 Kampe et al. ..... 75/244
5,505,246 4/1996 Colvin et al. ..... 164/61

*Primary Examiner*—Kuang Y. Lin
*Attorney, Agent, or Firm*—Andrew C. Hess; David L. Narciso

[57] ABSTRACT

The inside surface of the mold used to cast gamma titanium aluminide articles is pretreated with a facecoating of an inoculant such as titanium diboride or titanium carbide. When the molten metal of the composition that produces the gamma titanium aluminide is cast into the mold, the face-coating nucleates grains at the surface of the casting, which inhibits the formation of surface-connected porosity in the casting. Subsequent hot isostatic pressing of the article produces a sounder article than otherwise could be achieved.

17 Claims, 2 Drawing Sheets

LOW-POROSITY GAMMA TITANIUM ALUMINIDE CAST ARTICLES AND THEIR PREPARATION

The invention herein described was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to the preparation of cast gamma titanium aluminide articles, and, more particularly, to the control and reduction of porosity in such articles.

Titanium aluminides are a class of alloys whose compositions include at least titanium and aluminum, and typically some additional alloying elements such as chromium, niobium, vanadium, tantalum, manganese, or boron. The gamma titanium aluminides are based on the gamma phase found at nearly the equiatomic composition, with roughly 50 atomic percent each of titanium and aluminum, or slightly reduced amounts to permit the use of other alloying elements. The titanium aluminides, and particularly the gamma titanium aluminides, have the advantages of low density, good low and intermediate temperature strength and cyclic deformation resistance, and good environmental resistance.

Gamma titanium aluminides can be used in aircraft engines. They potentially have applications such as low-pressure turbine blades and vanes, bearing supports, compressor casings, high pressure and low pressure hangars, frames, and low pressure turbine brush seal supports. They may also have application in other products such as automotive valves and superchargers.

Gamma titanium aluminide articles for high-performance applications are normally prepared by the casting of a molten metal to nearly the final shape, and thereafter hot isostatically pressing the cast article. The objective of the hot isostatic pressing operation is to close and remove the internal shrinkage cavities that are present in the as-cast article. However, it is observed that in some operations even a long period of hot isostatic pressing of the as-cast article is not successful in closing the shrinkage porosity, and the final article still has at least some of the shrinkage porosity therein. Consequently, the mechanical properties of the final article are inferior to what otherwise is expected.

There is a need for an improved approach to the preparation of cast gamma titanium aluminide articles. The present invention fulfills this need, and further provides related advantages.

SUMMARY OF THE INVENTION

The present invention provides an approach to preparing gamma titanium aluminide cast and hot isostatically processed articles. The resulting articles have lower porosity (i.e., better soundness) in both the as-cast and hot isostatically processed articles, as compared with conventionally cast articles. The approach may be used in various casting operations, including both investment and die casting. There is no known limit to the types of articles that may be prepared by this approach or gamma titanium aluminide alloys that may be used.

In accordance with the invention, a method of preparing a gamma titanium aluminide article comprises the step of furnishing a mold having an inner surface defining the shape of an article. At least a portion of the inner surface has thereon a facecoating of an inoculant operable to nucleate grains during solidification of a molten metal which, upon solidification, forms a gamma titanium aluminide material. The face coating is preferably a titanium compound, most preferably titanium diboride or titanium carbide. The method further includes casting into the mold a charge of a molten metal which, upon solidification, forms a gamma titanium aluminide material, and cooling the cast charge. Optionally but preferably the cast and cooled charge is thereafter hot isostatically pressed.

Studies by the inventor indicate that the porosity found within conventionally cast titanium aluminides results from their, columnar grain structure produced during solidification and the resulting interdendritic paths.

These paths cause surface-connected porosity that prevents the subsequent hot isostatic pressing operation from closing the shrinkage porosity found within the casting. The inoculant at the mold surface nucleates more-equiaxed grains at the surface of the casting, preventing the columnar grain structure and the resulting surface porosity which would otherwise inhibit the closing of centerline porosity during hot isostatic pressing. The as-cast gamma titanium aluminide is therefore more sound, and the subsequent hot isostatic pressing is more successful in eliminating the internal shrinkage porosity. The final product is of better quality than the conventionally cast and cast-plus-hot isostatically pressed material.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment

DETAILED DESCRIPTION OF THE INVENTION

Figure 1:
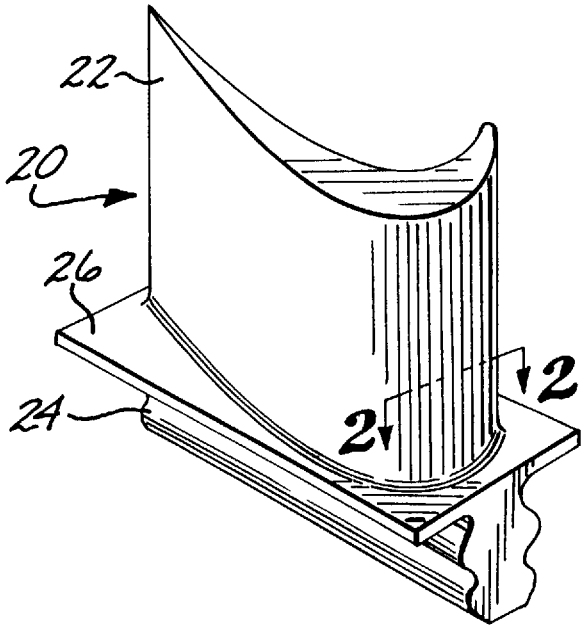
FIG. 1 is a perspective view of a gas turbine blade article.

FIG. 1 depicts a component of a gas turbine engine such as a turbine blade or turbine vane, and in this case a low-pressure turbine blade 20 made of a gamma titanium aluminide alloy. Other gas turbine components can benefit from the processing approach of the invention, such as, for example, bearing supports, compressor casings, high pressure and low pressure hangars, frames, and low pressure turbine brush seal supports. Components of other systems such as, for example, automotive valves and superchargers may also be made of gamma titanium aluminide alloys. The turbine blade 20 includes an airfoil 22 against which the flow of hot exhaust gas is directed. The turbine blade 20 is mounted to a turbine disk (not shown) by a dovetail 24 which extends downwardly from the airfoil 22 and engages a slot on the turbine disk. A platform 26 extends longitudinally outwardly from the area where the airfoil 22 is joined to the dovetail 24.

As used herein, "gamma titanium aluminide" articles are those having compositions capable of forming the gamma (γ) tanium aluminide phase found generally at, slightly below, and slightly above the equiatomic composition in the titanium-aluminum system and in titanium-aluminum-X systems. (All compositions herein are stated in atomic percent unless indicated to the contrary.) Although the composition is based upon the titanium-aluminum system, alloying additions X (such as chromium and niobium) are provided in some gamma titanium aluminide alloys to modify and improve the properties for specific applications. The gamma titanium aluminide alloys of most interest are multiphase alloys comprised primarily of gamma (TiAl) phase and having a nominal composition of from about 42 to about 49 atomic percent aluminum, balance titanium and, optionally, other alloying elements. However, the gamma phase field extends up to about 70 atomic percent aluminum, and such alloys are also considered gamma titanium aluminides.

According to conventional processing, the article such as the turbine blade 20 is cast from molten metal in a mold, typically an investment casting mold but also possibly in a permanent mold. The cast article is cooled to ambient temperature. Such an article typically has centerline porosity resulting from the facts that the outer portion of the article solidifies first against the mold wall, and that the center portions of the article thereafter experience externally constrained shrinkage upon solidification that results in cavities and porosity. The article is thereafter hot isostatically pressed ("HIPped") to reduce the size of the centerline cavities and porosity, and ideally to close and remove the centerline cavities and porosity entirely.

Figure 2:
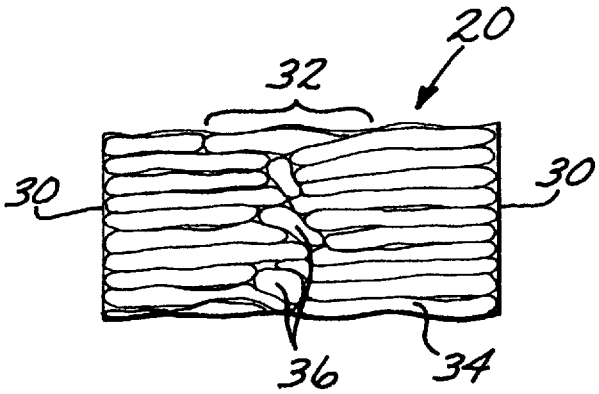
FIG. 2 is an idealized, enlarged sectional view through the article of FIG. 1, taken generally along line 2–2, of a conventionally cast and hot isostatically pressed article.

However, in some cases this conventional processing is not successful. FIG. 2 illustrates an idealized microstructure of the article, with the exterior surfaces 30 and the centerline region 32 indicated. Extending inwardly from the exterior surfaces 30 is a columnar grain structure 34. Centerline porosity 36 remains in the centerline region 32. Even extensive hot isostatic pressing at elevated temperatures and for extended periods of time, within the limits of what is acceptable metallurgically and economically, is not successful in eliminating this centerline porosity 36.

The inventor has determined that the inability to eliminate the centerline porosity results from the pronounced columnar grain structure 34 produced by solidification. This columnar grain structure produces surface-connected porosity which, in turn, prevents the closure of the centerline porosity 36 during the hot isostatic pressing. The present approach reduces the surface-connected porosity, so that the hot isostatic pressing is more successful in removing the interior porosity.

Figure 3:
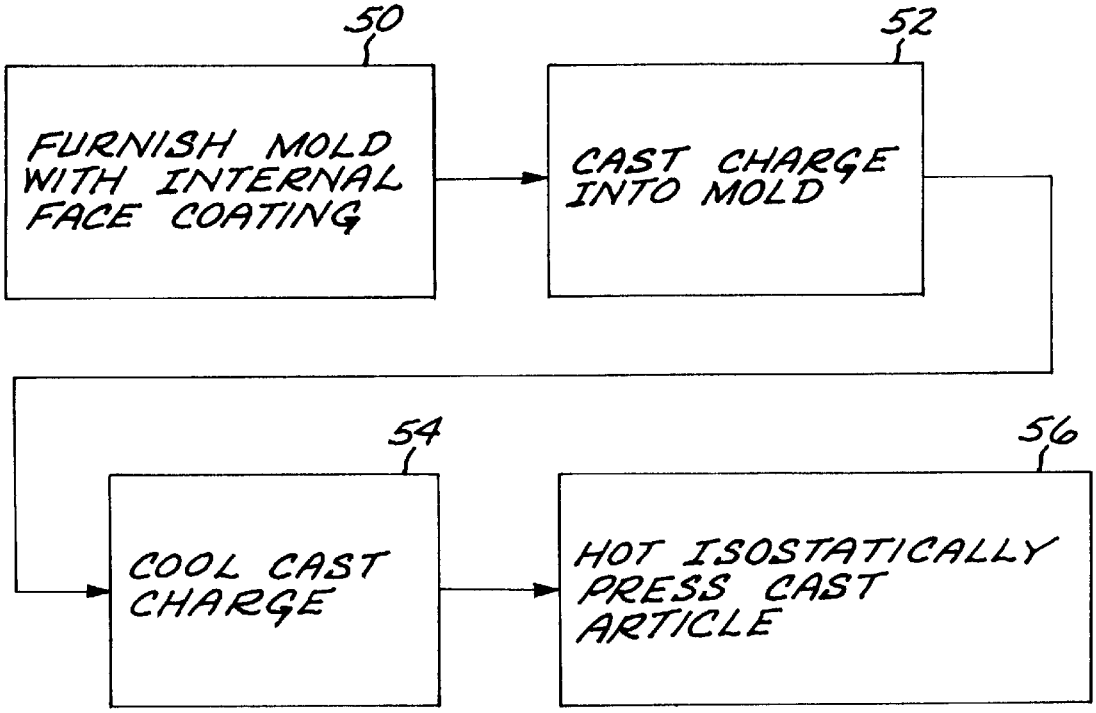
FIG. 3 is a block diagram of a process for preparing the article of FIG. 1, according to the invention.
Figure 4:
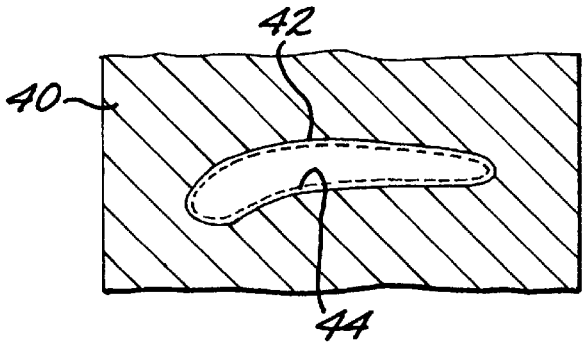
FIG. 4 is a sectional view of a casting mold used to make the article of FIG. 1.

According to the present approach as illustrated in FIG. 3 and FIG. 4, a mold 40, into which the turbine blade 20 (or other article) is cast, is furnished, numeral 50, with an internal facecoating of an inoculant operable to nucleate grains during solidification of a molten metal which, upon solidification, forms a gamma titanium alumirnide material. As shown in FIG. 4, the mold 40 has an inner surface 42 that defines the shape of the article. The inner surface 42 has a thin facecoating 44 of the inoculant thereon. The thickness of the facecoating 44 is normally quite small, on the order of 0.001 inch, and is exaggerated in FIG. 4 so as to be visible.

The facecoating 44 can be applied to the inner surface 42 in any operable manner, and the manner of application is typically determined by the nature of the mold. Most gamma titanium aluminides are cast using investment casting. In that approach as modified according to the present invention, a "fugitive" male model of the article is prepared. The male model is made of wax or other material that is driven out at a later stage of the operation, leading to the common name of "lost wax" process. The facecoating inoculant is deposited on the exterior of the male model. The facecoating inoculant is typically prepared as a slurry. The slurry is painted onto the exterior of the male model, and the fluid portion of the slurry is evaporated. A female mold is formed over the exterior of the male model so that the inner surface of the mold contacts the male model. The fugitive male model is removed, typically by heating the assembly of male model and female mold to vaporize and drive away the material of the male model, leaving the facecoating inoculant 44 affixed to the inner surface 42 of the mold 40, as seen in FIG. 4. The female mold 40 is typically made of a ceramic material such as aluminum oxide or yttrium oxide in the case of the casting of articles of gamma titanium aluminides. The procedures and techniques of investment casting, with the exception of the use of the facecoating inoculant, are well known for the casting of gamma titanium aluminides.

In permanent mold casting, the mold 40 is metallic and is provided in a split form with two halves. With the mold halves spread apart, the slurry is applied to the inner surfaces of the mold, and the fluid portion is evaporated to leave the facecoating on the inner surfaces. The halves are then closed together in registry for subsequent casting. Permanent mold casting is less commonly used for the casting of gamma titanium aluminides, but the present invention is operable with this approach as well.

The inoculant used in the facecoating is a material operable to nucleate grains during solidification of a molten metal which, upon solidification, forms a gamma titanium aluminide material. Because the gamma titanium aluminide contains a large proportion of titanium, the facecoating is desirably titanium based. The preferred facecoating inoculants are titanium diboride ($TiB_2$) and titanium carbide (TiC). The inoculants are furnished as fine particles and are desirably entrained in a slurry that is operable to permit the application to the inner walls of the mold as previously described and permits evaporation of the fluid phase. The slurry carrier, such as water, also provides a low level of adherence of the inoculant particles to the inner surface of the mold during handling of the mold, but allows the particles to be released to the near-surface regions of the molten metal during casting. The particles are mixed with the carrier so as to form a paint that may be applied to the inner surfaces 42.

The use of inoculants applied to mold walls is known for other applications, but is not, to the inventor's knowledge, known in the processing of gamma titanium aluminides. For example, the use of a reducible metal compound to control grain size in nickel-based alloys is described in U.S. Pat. No. 3,158,912. However, the use of inoculants to produce equiaxed structures rather than columnar structures is often not successful, see U.S. Pat. No. 3,614,976, at col. 2, lines 14–18. In some instances, particles of materials such as titanium diboride have been introduced into the molten metal rather than used as an inoculant to avoid films of aluninum on the die surfaces in permanent mold casting, as described in U.S. Pat. 5,505,246. In none of these approaches is an inoculant taught for achieving the reduction of porosity in gamma titanium aluminides by obtaining equiaxed rather than columnar grains.

Returning to the block diagram of FIG. 3, a charge of the molten metal is provided and cast into the facecoated mold, numeral 52. Any molten metal that results in a solid article of gamma titanium aluminide may be used. In the preferred embodiment, the molten metal and thence the final article has a nominal composition, in atomic percent, of about 46 percent aluminum, 2 percent chromium, 2 percent niobium, balance titanium totalling 100 percent. Some other nominal compositions, in atomic percent, of interest include 48 percent aluminum, 2 manganese, 2 niobium, balance titanium totalling 100 percent; 47 percent aluminum 4 percent niobium, 1 percent tungsten, balance titanium totalling 100 percent; and 47 percent aluminum, I percent manganese, 2 percent niobium, small amounts of tungsten, molybdenum, and/or silicon, balance titanium totalling 100 percent. (The inoculant alters the composition slightly but insignificantly for the present purposes.) The charge is cooled and solidified, numeral 54, and further cooled to lower temperature such as ambient temperature. The cast article is thereafter removed from the mold.

This as-cast article could be used for some low-performance, non-demanding applications in this form. However, it contains some of the centerline porosity, which is reduced and ideally removed even further if the article is to be used for high-performance applications. To reduce and remove the centerline porosity, the article is hot isostatically pressed, numeral 56. For gamma titanium aluminides, a typical hot isostatic pressing treatment is a temperature of from about 2165° F. to about 2300° F. for a time of from about 3 to about 5 hours, and an isostatic pressing pressure of from about 25,000 to about 30,000 pounds per square inch.

Figure 5:
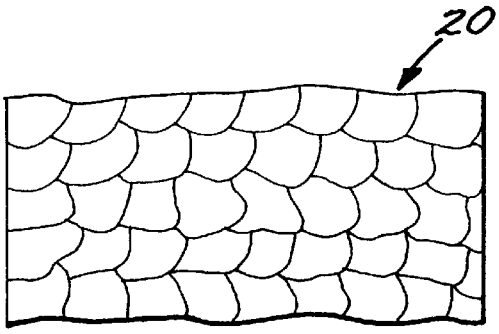
FIG. 5 is an idealized, enlarged sectional view like that of FIG. 2, except that the article is processed according to the approach of FIG. 3.

FIG. 5 illustrates the idealized microstructure of the article after processing by the approach of the invention as illustrated in FIG. 3. The grain structure is not columnar, and in general is more nearly equiaxed. Due to the equiaxed surface structure, there is no surface porosity that prevents closure of the centerline porosity during hot isostatic pressing, so that the final structure is sound.

This invention has been described in connection with specific embodiments and examples. However, those skilled in the art will recognize various modifications and variations of which the present invention is capable without departing from its scope as represented by the appended claims.

What is claimed is:

1. A method of preparing a gamma titanium aluminide article, comprising the steps of:

furnishing a mold having an inner surface defining the shape of an article, at least a portion of the inner surface having thereon a facecoating of an inoculant operable to nucleate grains during solidification and to cause an as-cast gamma titanium aluminide material to form a nearly equiaxed structure rather than a columnar structure at the surface of a casting;

casting into the mold a charge of a molten metal which, upon solidification, forms a gamma titanium aluminide material; and cooling the cast charge.

2. The method of claim 1, wherein the step of furnishing a mold includes the steps of preparing a fugitive male model of the article;

depositing the facecoating inoculant on the exterior of the male model;

forming a female mold onto the exterior of the male model so that the inner surface of the mold contacts the male model; and removing the fugitive male model, leaving the facecoating inoculant affixed to the inner surface of the mold.

3. The method of claim 1, wherein the step of furnishing a mold includes the steps of providing a permanent die-casting mold having the inner surface; and applying a coating of the facecoating inoculant to the inner surface of the permanent die-casting mold.

4. The method of claim 1, wherein the step of furnishing includes the step of providing as the facecoating inoculant a compound of titanium.

5. The method of claim 1, wherein the step of furnishing includes the step of providing as the facecoating inoculant a compound selected from the group consisting of titanium diboride and titanium carbide.

6. The method of claim 1, wherein the step of furnishing a mold includes the step of furnishing a mold whose inner surface defines a structure selected from the group consisting of a turbine blade and a turbine vane.

7. The method of claim 1, wherein the step of casting includes the step of providing a charge having a nominal composition, in atomic percent, selected from the group consisting of 46 percent aluminum, 2 percent chromium, 2 percent niobium, balance titanium totaling 100 percent; 48 percent aluminum, 2 manganese, 2 niobium, balance titanium totaling 100 percent; 47 percent aluminum 4 percent niobium, 1 percent tungsten, balance titanium totaling 100 percent; and 47 percent aluminum, 1 percent manganese, 2 percent niobium, small amounts of tungsten, molybdenum, or silicon, balance titanium totaling 100 percent.

8. A method of preparing a gamma titanium aluminide article, comprising the steps of:

furnishing a mold having an inner surface defining the shape of an article, at least a portion of the inner surface having thereon a facecoating of an inoculant operable to nucleate grains during solidification and to cause an as-cast gamma titanium aluminide material to form a nearly equiaxed structure rather than a columnar structure at the surface of a casting;

casting into the mold a charge of a molten metal which, upon solidification, forms a gamma titanium aluminide material;

cooling the cast charge; and thereafter hot isostatically pressing the cast and cooled charge.

9. The method of claim 8 wherein the step of furnishing a mold includes the steps of preparing a fugitive male model of the article;

depositing the facecpating inoculant on the exterior of the male model;

forming a female mold onto the exterior of the male model so that the inner surface of the mold contacts the male model; and removing the fugitive male model, leaving the facecoating inoculant affixed to the inner surface of the mold.

10. The method of claim 8 wherein the step of furnishing a mold includes the steps of providing a permanent die-casting mold having the inner surface; and applying a coating of the facecoating inoculant to the inner surface of the permanent die-casting mold.

11. The method of claim 8, wherein the step of furnishing includes the step of providing as the facecoating inoculant a compound of titanium.

12. The method of claim 8, wherein the step of furnishing includes the step of providing as the facecoating.inoculant a compound selected from the group consisting of titanium diboride and titanium carbide.

13. The method of claim 8, wherein the step of furnishing a mold includes the step of furnishing a mold whose inner surface defines a structure selected from the group consisting of a turbine blade and a turbine vane.

14. The method of claim 8, wherein the step of casting includes the step of providing a charge having a nominal composition, in atomic percent, selected from the group consisting of 46 percent aluminum, 2 percent chromium, 2 percent niobium, balance titanium totaling 100 percent; 48 percent aluminum, 2 manganese, 2 niobium, balance titanium totalling 100 percent, 47 percent aluminum 4 percent niobium, 1 percent tungsten, balance titanium totaling 100 percent; and 47 percent aluminum, 1 percent manganese, 2 percent niobium, small amounts of tungsten, molybdenum, or silicon, balance titanium totaling 100 percent.

15. A method of preparing a gamma titanium aluminide article, comprising the steps of:

furnishing a mold having an inner surface defining the shape of an article, at least a portion of the inner surface having thereon a facecoating of an inoculant operable to nucleate grains during solidification of a molten metal which, upon solidification, forms a gamma titanium aluminide material;

casting into the mold a charge of a molten metal which, upon solidification, forms a gamma titanium aluminide material having nearly equiaxed grains at the surface of the casting adjacent to the inner surface of the mold; and cooling the cast charge.

16. The method of claim 15, wherein the step of furnishing includes the step of providing as the facecoating inoculant a compound selected from the group consisting of titanium diboride and titanium carbide.

17. The method of claim 15, wherein the step of casting includes the step of providing a charge having a nominal composition, in atomic percent, selected from the group consisting of 46 percent aluminum, 2 percent chromium, 2 percent niobium, balance titanium totaling 100 percent; 48 percent aluminum, 2 manganese, 2 niobium, balance titanium totaling 100 percent; 47 percent aluminum 4 percent niobium, 1 percent tungsten, balance titanium totaling 100 percent; and 47 percent aluminum, 1 percent manganese, 2 percent niobium, small amounts of tungsten, molybdenum, or silicon, balance titanium totaling 100 percent.

* * * * *